US008044347B2

(12) United States Patent
Yamamoto et al.

(10) Patent No.: US 8,044,347 B2
(45) Date of Patent: Oct. 25, 2011

(54) METHOD FOR PROCESSING MASS ANALYSIS DATA AND MASS SPECTROMETER

(75) Inventors: Yoshitake Yamamoto, Nagaokakyo (JP); Yoshikatsu Umemura, Osaka (JP)

(73) Assignee: Shimadzu Corporation, Kyoto (JP)

( * ) Notice: Subject to any disclaimer, the term of this patent is extended or adjusted under 35 U.S.C. 154(b) by 236 days.

(21) Appl. No.: 12/425,114

(22) Filed: Apr. 16, 2009

(65) Prior Publication Data

US 2009/0266983 A1 Oct. 29, 2009

(30) Foreign Application Priority Data

Apr. 25, 2008 (JP) ..... 2008-115857

(51) Int. Cl.
*H01J 49/00* (2006.01)

(52) U.S. Cl. ..... 250/288; 250/281; 250/282; 250/287

(58) Field of Classification Search ..... 250/281, 250/282, 287, 288
See application file for complete search history.

(56) References Cited

U.S. PATENT DOCUMENTS

| | | | | |
|---|---|---|---|---|
| 6,487,523 | B2 * | 11/2002 | Jarman et al. | 702/189 |
| 6,737,642 | B2 | 5/2004 | Syage et al. | |
| 7,519,514 | B2 * | 4/2009 | Roushall | 702/191 |
| 2003/0078739 | A1 * | 4/2003 | Norton et al. | 702/22 |
| 2003/0173514 | A1 * | 9/2003 | Syage et al. | 250/287 |
| 2007/0158542 | A1 * | 7/2007 | Bauer et al. | 250/282 |
| 2009/0090861 | A1 * | 4/2009 | Willis et al. | 250/287 |
| 2009/0266983 | A1 * | 10/2009 | Yamamoto et al. | 250/287 |
| 2010/0096545 | A1 * | 4/2010 | Malek et al. | 250/282 |
| 2010/0127165 | A1 * | 5/2010 | Hofstadler et al. | 250/282 |

FOREIGN PATENT DOCUMENTS

JP 2001-099821 A 4/2001

OTHER PUBLICATIONS

Dmitriy Petrov, et al., "Compression for LC-MS Data, acquired on high resolution ESI-o-TOF-MS," Abstracts of the 16th International Mass Spectrometry Conference, 2003.

Alpha Ltd. Co, "Alpha Ltd. Co Research consulting Mass Spectrometry development and applications," 2003, <http://www.alpha-ms.com/references.htm>.

* cited by examiner

*Primary Examiner* — Michael Maskell
(74) *Attorney, Agent, or Firm* — Sughrue Mion, PLLC

(57) ABSTRACT

Intensity data of the signals produced by an ion detector are sequentially stored in a data processor, with each piece of intensity data being associated with time t required for each of the various ions ejected from an ion trap to fly through a time-of-flight space and reach the ion detector. The data obtained within a time range T2 corresponding to a measurement mass range are extracted as profile data. The data obtained within either a time range T1 before the arrival of an ion having the smallest m/z value or a time range T3 after the arrival of an ion having the largest m/z value are extracted as noise component data. Various kinds of noise information such as the noise level or standard deviation are calculated from the noise component data. Based on this noise information, a noise component is removed from the profile data. For every mass scan cycle, the noise component data and profile data are almost simultaneously obtained. Therefore, even if the electrical noise from the ion detector changes with time, the noise can be properly removed with little influence from that change of the noise.

12 Claims, 4 Drawing Sheets

Fig. 4
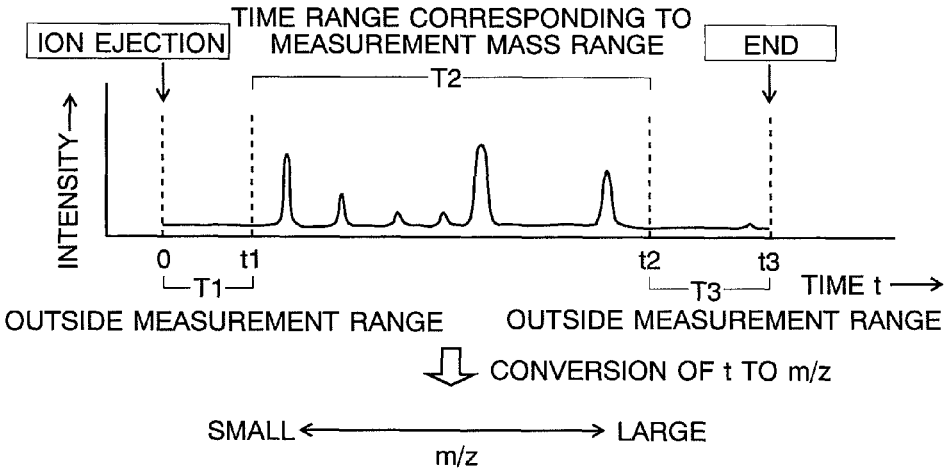
Fig. 5
| | |
|---|---|
| EVENT [1] | MEASUREMENT RANGE OF m/z :100 - 1000<br>IONIZATION POLARITY : POSITIVE<br>SPECTRUM-AVERAGING COUNT : 2 |
| EVENT [2] | MEASUREMENT RANGE OF m/z :100 - 1000<br>IONIZATION POLARITY : NEGATIVE<br>SPECTRUM-AVERAGING COUNT : 3 |
Fig. 6
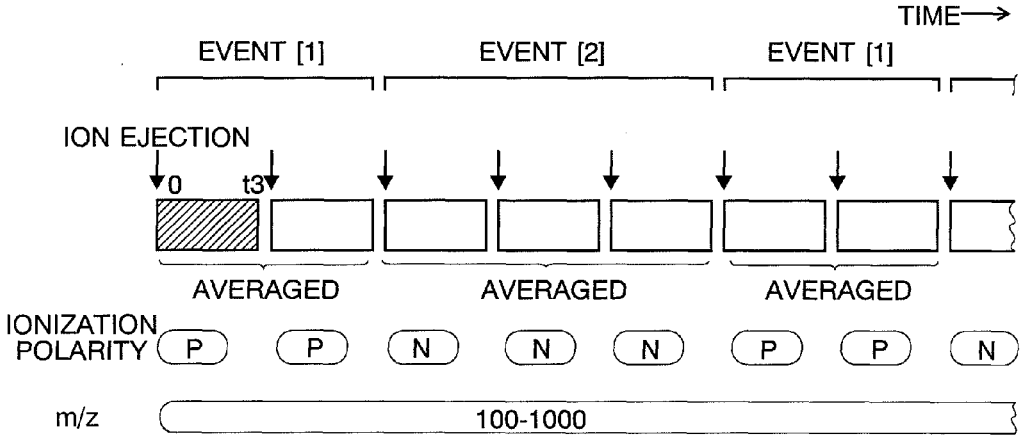

METHOD FOR PROCESSING MASS ANALYSIS DATA AND MASS SPECTROMETER

The present invention relates to a method for processing data obtained by a mass spectrometer and also to a mass spectrometer capable of processing data by such a method. More specifically, it relates to a data-processing technique for removing noise superimposed on the data collected by a mass analysis.

BACKGROUND OF THE INVENTION

A chromatograph mass spectrometer, which consists of the combination of a high-speed liquid chromatograph (LC) or gas chromatograph (GC) and a mass spectrometer (MS), is capable of repeating a mass analysis over a predetermined measurement mass range (specifically, a mass-to-charge ratio range over which the mass analysis is to be performed) to obtain a series of mass spectra of various components of a sample eluted from a column of the LC of GC with the lapse of time. An ion detector of the mass spectrometer typically includes a secondary electron multiplier combined with a conversion dynode, microchannel plate or similar element.

The ion detector and other elements in the subsequent stages, such as a current/voltage converter or amplifier, include electrical circuits, which inevitably produce electrical noise and may also receive external noise. Therefore, the detection signal obtained during the mass scan operation will contain an electrical noise signal superimposed on a signal produced by the ions originating from the sample. Given these factors, conventional mass spectrometers perform a noise-removing process, which includes measuring a noise component due to the aforementioned electrical factors before the measurement of a target sample, and then subtracting the noise information obtained by the noise measurement from the mass spectrum information of the target sample.

Mass spectrometers perform an averaging process on a set of data obtained in two or more mass scan cycles to stabilize the shape of mass spectra, and some of these apparatuses can change the number of mass scan cycles for the averaging process during the measurement according to a change in the analysis conditions. For example, the apparatus disclosed in Japanese Unexamined Patent Application Publication No. 2001-99821 can switch its operational mode between the positive-ion measurement mode and the negative-ion measurement mode for each mass scan cycle or between the normal mass analysis and the MS/MS analysis including a dissociating operation. Changing the number of mass scan cycles creates a different state of noise. Therefore, the aforementioned noise-removing process should be preceded by a preprocess in which the noise information obtained by measuring the noise component is appropriately processed by a statistical method that takes into account the number of mass scan cycles.

However, the level of the electrical noise from the circuits of the ion detector, amplifier and other elements usually changes with time since the state of this noise is sensitive to temperature and other factors. Therefore, in some cases it is impossible to appropriately remove the noise by performing the noise-removing process using the noise information obtained by the preliminary measurement of the noise before the measurement of the target sample.

One known method for avoiding these problems is to perform a noise-removing process using additional noise information obtained by repeatedly measuring the noise component at specific intervals of time during the measurement of the target sample as well as before the same measurement. However, this technique cannot consistently provide a desired noise-removing effect since there is a certain time-gap between the measurement of the target sample and that of the noise component; if the electrical noise has increased during the measurement of the target sample, the time-gap may prevent this increase in the noise from being correctly reflected in the noise information.

The present invention has been developed in view of these problems. Its objective is to provide a method of processing mass analysis data capable of accurately creating mass spectra by properly removing electrical noise from an ion detector, amplifier or other elements, and also a mass spectrometer capable of such a data processing.

SUMMARY OF THE INVENTION

A first aspect of the present invention aimed at solving the previously described problems is a method for processing data collected by a mass spectrometer including an ion source, a mass separator for performing a mass separation of ions produced by the ion source and a detector for detecting the ions resulting from the mass separation, the data being used to create a mass spectrum over a predetermined mass range. This method includes:

a) a noise information acquiring step for extracting data obtained within a range where none of the ions originating from a sample arrive at the detector from among measurement data collected for each mass scan operation, and for calculating a threshold value by a statistical process based on the extracted data;

b) a profile data acquiring step for extracting a profile data, which is a data that corresponds to a measurement mass range among the measurement data;

c) a noise removing step for removing a noise component from the profile data with reference to the threshold value; and d) a spectrum creating step for creating a mass spectrum, using the profile data from which the noise component has been removed.

A second aspect of the present invention aimed at solving the previously described problems is a mass spectrometer for carrying out the method for processing mass analysis data according to the first aspect of the present invention. This apparatus includes an ion source, a mass separator for performing a mass separation of ions produced by the ion source, a detector for detecting the ions resulting from the mass separation, and a data processor for processing measurement data obtained by the detector, the measurement data being used to create a mass spectrum over a predetermined mass range. The data processing section includes:

a) a noise information acquiring section for extracting data obtained within a range where none of the ions originating from a sample arrive at the detector from among the measurement data collected for each mass scan operation, and for calculating a threshold value by a statistical process based on the extracted data;

b) a profile data acquiring section for extracting a profile data, which is a data that corresponds to the measurement mass range among the measurement data;

c) a noise removing section for removing a noise component from the profile data with reference to the threshold value; and d) a spectrum creating section for creating a mass spectrum, using the profile data from which the noise component has been removed.

The mass separator in the present invention is not limited to any specific mode or structure. For example, it may be a time-of-flight mass separator or quadrupole mass filter. For the time-of-flight mass separator, the mass scan operation is the operation of continuously acquiring detection signals from the ion detector for a predetermined period of time from either the point in time when an ion is introduced into the time-of-flight mass separator or the point in time when an ion is ejected from an ion trap or similar device to be introduced into the time-of-flight mass separator. For the quadrupole mass filter, the mass scan operation is the operation of continuously acquiring detection signals from the ion detector while sweeping the voltage applied to the electrodes of the filter over a predetermined range.

The method for processing mass analysis data according to the first aspect of the present invention can be carried out by the mass spectrometer according to the second aspect of the present invention. Given a measurement mass range, the data processor of this mass spectrometer divides a series of measurement data obtained for each cycle of a mass scan operation into the data obtained within a time range where none of the ions originating from a sample supplied into the ion source arrive at the detector and the data obtained within a time range that corresponds to the measurement mass range. The electrical noise from the detector and other elements is contained in both groups of data, whereas the signal intensity of the ions originating from the sample is reflected only in the latter group. Accordingly, the noise information acquiring section calculates a threshold value from the former group of data. Using this threshold value as the noise information, the noise removing section removes the noise from the latter group of data extracted by the profile data acquiring section. As a result, a set of profile data free from noise components is obtained. Based on this noise-free data, the spectrum creating section creates a mass spectrum.

Thus, the data processing method according to the first aspect of the present invention and the mass spectrometer according to the second aspect of the present invention provide both the spectrum information reflecting the intensity of the ions for each mass and the information relating to the noise component within each single cycle of mass scan operation. In a strict sense, these two kinds of information are not simultaneously obtained. However, the period of time for a single cycle of mass scan operation is normally so short that it can be considered to have been obtained virtually simultaneously. The temporal change of the noise is negligibly small and has no negative impact on the accurate removal of the electrical noise superimposed on the profile data. Except for a pulsed noise that lasts for only a short period of time, most forms of burst noise can also be properly removed. These factors all improve the accuracy of the mass spectrum.

When the mass separator is a time-of-flight mass separator as in the previous case, there cannot be any ion impinging on the detector within a time range from the point in time when ions are introduced into the time-of-flight mass separator to the point in time when an ion having the smallest mass within the measurable mass range reaches the detector, and within a time range from the point in time when an ion having the largest mass within the measurable mass range reaches the detector to the point in time when the collection of data for one cycle of mass scan operation is completed. Accordingly, the noise information acquiring section can extract data from one or both of these two time ranges to calculate the threshold value.

However, due to an unintended delay in the flight of the ions or for other reasons, a signal intensity of an ion may be observed within the time range where none of the ions originating from the sample should reach the detector. To exclude such an ion, it is preferable to prevent a signal intensity from being reflected in the noise information, i.e. the threshold value, if the intensity is equal to or higher than a predetermined level.

In one mode of the second aspect of the present invention, the mass spectrometer is capable of repeatedly performing the mass scan operation under different sets of analysis conditions, and further includes: a condition setting section for specifying the analysis conditions for the mass scan operation; and an analysis controlling section for collecting data for each mass scan operation while cyclically repeating a series of mass scan operations performed under different sets of analysis conditions specified through the condition setting section. The noise information acquiring section extracts data corresponding to the noise from the measurement data obtained for each of the mass scan operations performed under the different sets of analysis conditions.

The analysis conditions are the conditions that affect the generation and detection of ions. For example, they may be a combination of the ionization polarity (i.e. the polarity of ions generated by the ion source), the measurement mass range, the number of averaging count (or the number of mass scan operations to be performed) for creating spectrum information, and so on. For a mass spectrometer capable of an $MS^n$ analysis including a dissociating operation of the selected ion, it is possible to include the value of n in the analysis conditions.

In the previous mode of the mass spectrometer, both noise information and spectrum information are obtained for each mass scan operation even in the case where the mass scan operation is repeated under different sets of analysis conditions. Therefore, even if the measurement is performed while changing analysis conditions (especially, while changing the averaging count for the spectrum), it is possible to correctly obtain noise information and accurately remove the noise without performing a statistical process taking into account the averaging count.

BRIEF DESCRIPTION OF THE DRAWINGS

FIG. 4 is a diagram illustrating an operation of the LC/IT-TOFMS referring to a signal waveform obtained by one cycle of mass scan operation.

FIG. 5 is a table showing an example of the setting of event measurement conditions.

FIG. 6 is a diagram illustrating an operation of the LC/IT-TOFMS during a repeated mass scan operation.

DETAILED DESCRIPTION OF A PREFERRED EMBODIMENT

As one embodiment of the present embodiment, a liquid chromatograph/ion-trap time-of-flight mass spectrometer (LC/IT-TOFMS) is hereinafter detailed with reference to FIGS. 1 to 6.

Figure 1:
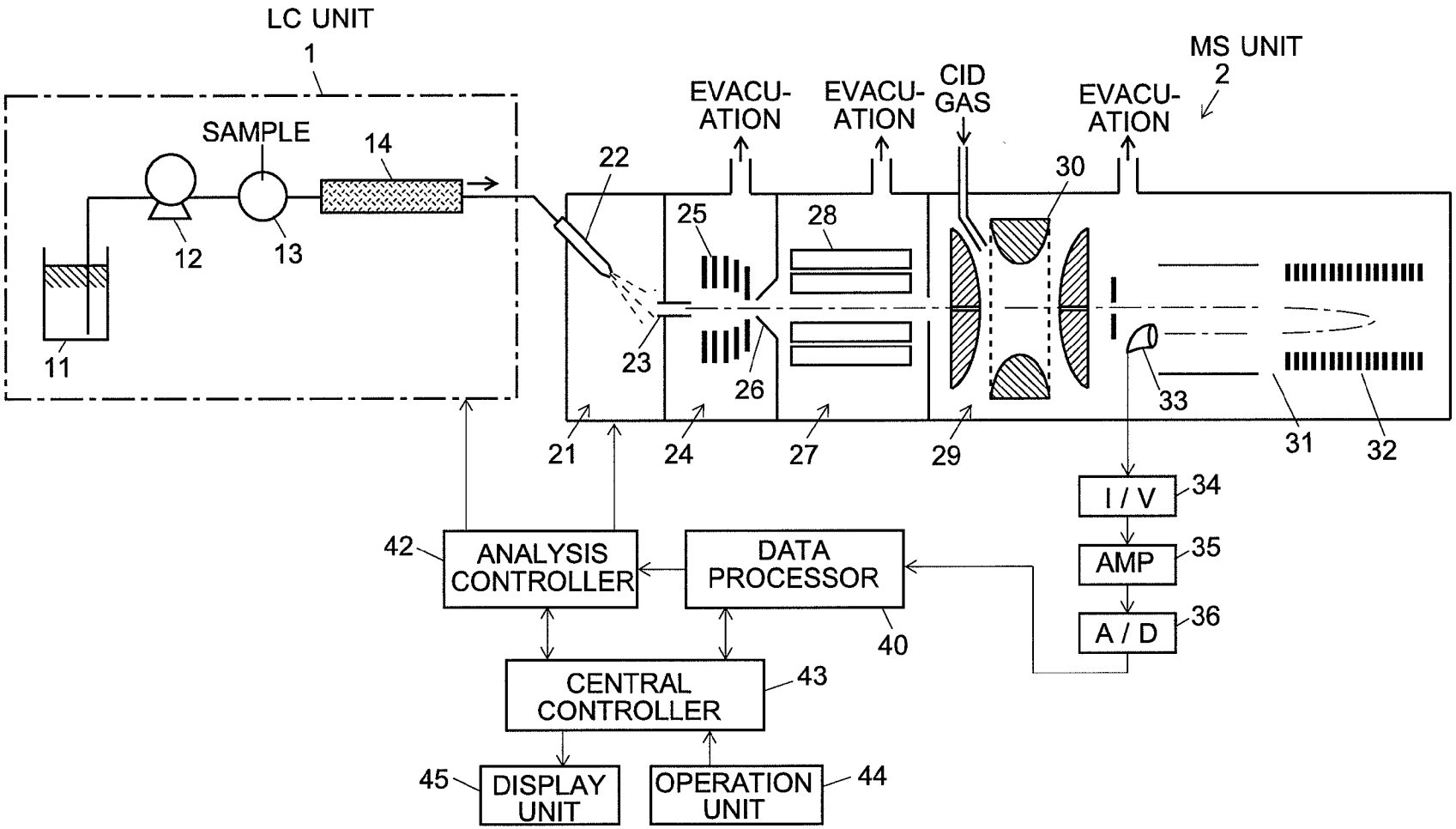
FIG. 1 is a configuration diagram showing the main components of an LC/IT-TOFMS according an embodiment of the present invention.

FIG. 1 is a configuration diagram showing the main components of the LC/IT-TOFMS of the present embodiment. This apparatus includes a liquid chromatograph (LC) unit 1 and mass spectrometer (MS) unit 2 as its main components, with an atmospheric pressure ionization interface connecting the LC unit 1 to the MS unit 2. The ionization interface in the present embodiment is an electrospray ionization (ESI) interface. However, the ionization method is not limited to this type. It is possible to use a different type of ionization interface, such as an atmospheric chemical ionization (APCI) interface or atmospheric photoionization (APPI) interface.

In the LC unit 1, a liquid supply pump 12 suctions a mobile phase stored in a mobile phase container 11 and supplies it through an injector 13 into a column 14 at a constant flow rate. When a sample is injected through the injector 13, the flow of mobile phase conveys the sample into the column 14. While passing through the column 14, the sample is separated into various components along the time axis. These components are eluted from the outlet of the column 14 at different points in time and introduced into the MS unit 2.

The MS unit 2 has an ionization chamber 21 maintained at atmospheric pressure and an analysis chamber 29 maintained in a high-vacuum state by an evacuating action of a turbo molecular pump (not shown). These two chambers are intervened by the first and second intermediate vacuum chambers 24 and 27 in which the vacuum degree is increased in a stepwise manner. The ionization chamber 21 communicates with the first intermediate vacuum chamber 24 via a thin desolvation pipe 23. The first intermediate vacuum chamber 24 communicates with the second intermediate vacuum chamber 27 via an orifice with a small diameter formed at the apex of a conical skimmer 26.

When an eluate containing the sample components supplied from the LC unit 1 reaches an ESI nozzle 22 serving as the ion source of the present invention, the eluate will be charged in a biased form due to a DC high voltage applied from a high-voltage source (not shown), to be sprayed into the ionization chamber 21 in the form of charged droplets. These charged droplets collide with gas molecules originating from air and are broken into much smaller droplets. These droplets are quickly dried (or desolvated), allowing the sample molecules to vaporize. The sample molecules cause an ion evaporation reaction and turn into ions. The small droplets containing the resultant ions are drawn into the desolvation pipe 23 due to a pressure difference. When the droplets pass through this pipe 23, the desolvation of those droplets further proceeds, producing more ions. While passing through the two intermediate vacuum chambers 24 and 27, the ions are converged by ion guides 25 and 28 and fed into the analysis chamber 29. Within this chamber 29, the ions are introduced into a ion trap 30 with three-dimensional quadrupole electrodes.

Within the ion trap 30, the ions are temporarily captured and stored by a quadrupole electric field created by radio-frequency voltages applied from a power source (not shown) to the electrodes. At a predetermined point in time, the various ions stored in the ion trap 30 are collectively given a kinetic energy and ejected from the ion trap 30 toward a time-of-flight mass separator (TOF) 31 serving as the mass separator of the present invention. This means that the ion trap 30 is the start point for the ions to fly into the TOF 31. The TOF 31 is provided with a reflection electrode 32 to which a DC voltage is applied from a DC power source (not shown). The DC voltage creates a DC electric field, which makes the ions turn back halfway and reach an ion detector 33 serving as the detector of the present invention. Among the ions collectively ejected from the ion trap 30, an ion having a smaller mass-to-charge ratio (m/z) flies faster and reaches the ion detector 33 with a time difference corresponding to its m/z value. The ion detector 33 produces an electric current corresponding to the number of the received ions and outputs it as the detection signal.

This detection signal is converted into a voltage signal by a current/voltage (I/V) converter 34 and amplified by an amplifier 35. The amplified signal is converted to a digital value by an analogue to digital (A/D) converter 36 and sent to a data processor 40. The data processor 40 measures the signal intensity of the ions with respect to the period of time from the point in time when the ions were collectively ejected from the ion trap 30 to the point in time when each ion reaches the ion detector 33. The data processor 40 converts the time information into mass information to create a mass spectrum with the coordinate axis representing the m/z value and the vertical axis representing the signal intensity. It also creates a total ion chromatogram and a mass chromatogram with the lapse of time.

An analysis controller 42 is responsible for controlling the operations of the LC unit 1 and MS unit 2 to conduct the LC/MS analysis according to the instructions from a central controller 43. An operation unit 44 and display unit 45, both serving as a user interface, are connected to the central controller 43. Upon receiving user operations through the operation unit 44, the central controller 43 gives various commands concerning the analysis to the analysis controller 42 and data processor 40, or displays analysis results, such as a mass spectrum, on the display unit 45. Most of the functions of the central controller 43, analysis controller 42 and data processor 40 can be implemented by a personal computer with a specific controlling/processing software program installed therein.

As shown in FIG. 1, the ion trap 30 is provided with a gas supplier for supplying a collision-induced dissociation (CID) gas, such as an argon gas. Supplying the CID gas causes ions stored within the ion trap 30 to be dissociated into product ions by the CID process. In the case of an $MS^n$ analysis such as an MS/MS analysis, various kinds of ions are initially stored within the ion trap 30, after which the voltages applied to the electrodes are controlled so that the ion with a specific mass will be selectively held as a precursor ion from those ions. Then, the CID gas is introduced into the ion trap 30 to help the dissociation of the precursor ion. The resultant product ions are collectively ejected from the ion trap 30 toward the TOF 31, which separately detects those ions with respect to their m/z value. Thus, a mass spectrum of the product ions can be obtained.

Figure 2:
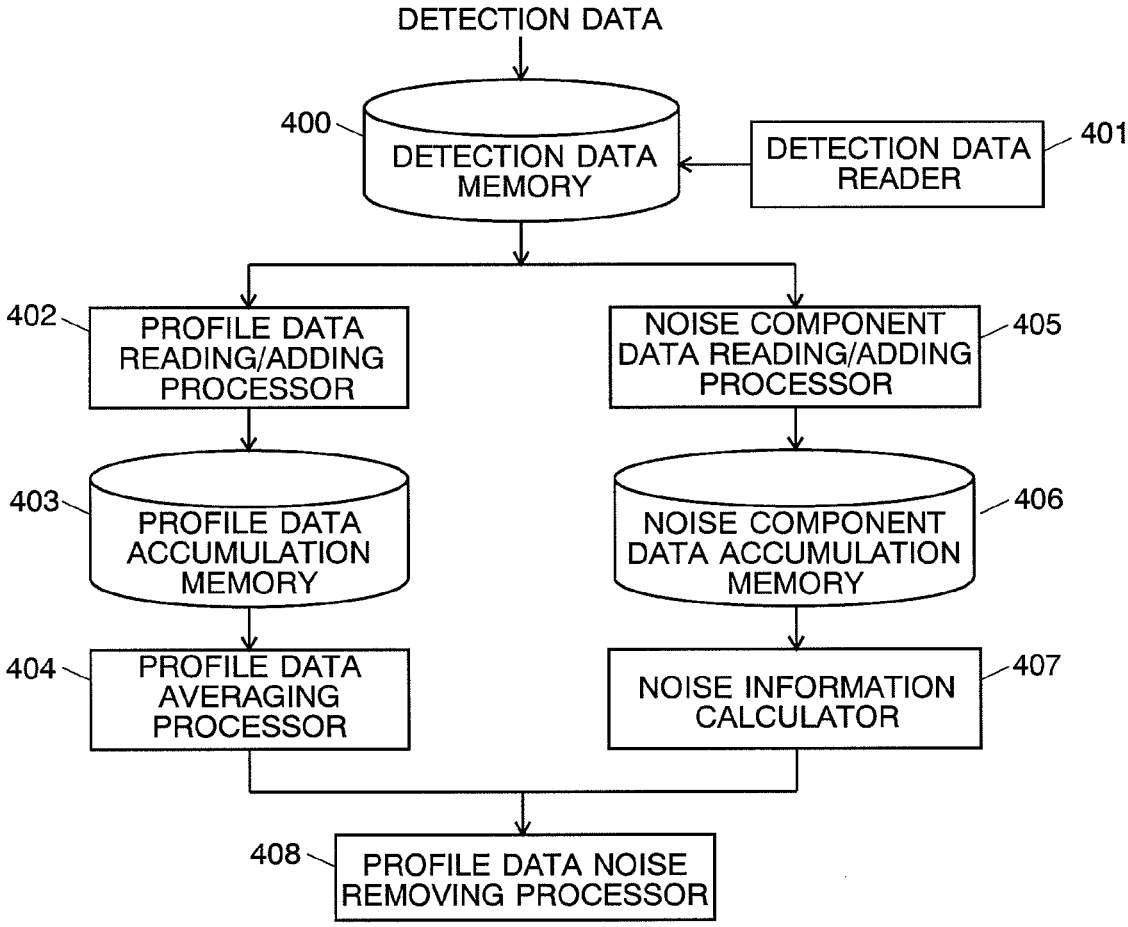
FIG. 2 is a functional configuration diagram showing the main components of the data processor of the LC/IT-TOFMS.

FIG. 2 is a functional configuration diagram showing the main components of the data processor 40 for performing the characteristic operations of the present apparatus.

As already explained, the detection signals produced by the ion detector 33 are converted into digital data. These digitized detection data are sequentially stored through a detection data reader 401 into a detection data memory 400. A profile data reading/adding processor 402 selectively reads out profile data (i.e. the data that correspond to the measurement mass range) from the data stored in the detection data memory 400, and stores the selected data into a profile data accumulation memory 403 in such a manner that these data are added to the data already present in the same memory 403. Meanwhile, a noise component data reading/adding processor 405 selectively reads out noise component data (i.e. the data that correspond to a range outside the measurement mass range) from the data stored in the detection data memory 400, and stores the selected data into a noise component data accumulation memory 406 in such a manner that these data are added to the data already present in the same memory 406. The accumulation process described to this point is performed almost in real time with the acquisition of detection data during the mass scan operation by the MS unit 2.

Every time the accumulation process is performed multiple times as specified by the averaging count in the event measurement conditions which will be described later, a profile data averaging processor 404 reads out the accumulated data from the profile data accumulation memory 403 and divides the data by the averaging count to obtain average values. Meanwhile, after the accumulation process, a noise information calculator 407 similarly reads out the accumulated data from the noise component data accumulation memory 406 and calculates various kinds of noise information, such as the noise level (intensity) or standard deviation. A profile data noise removing processor 408 performs a noise-removing operation using the noise information to obtain profile data free from the influence of the noise.

Figure 3:
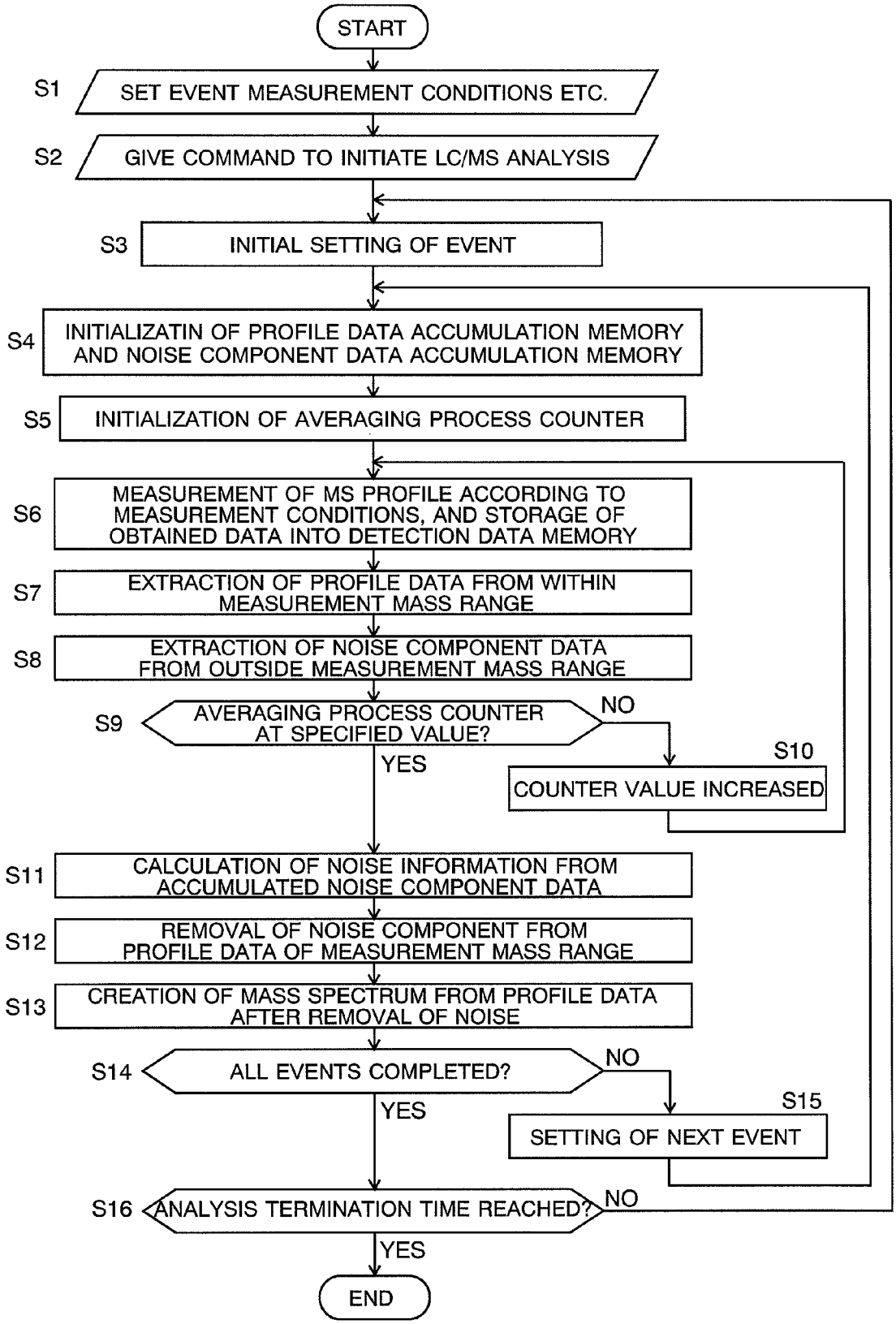
FIG. 3 is a flow chart showing the controlling/processing steps of an operation characteristic of the LC/IT-TOFMS.

A characteristic operation of the LC/IT-TOFMS having the previously described configuration is hereinafter described with reference to FIGS. 3 to 6. FIG. 3 is a flow chart showing the controlling/processing steps of this characteristic operation. FIG. 4 is a diagram illustrating an operation of the LC/IT-TOFMS referring to a signal waveform obtained by one cycle of mass scan operation. FIG. 5 is a table showing an example of the setting of event measurement conditions. FIG. 6 is a diagram illustrating an operation of the LC/IT-TOFMS during a repetition of mass scan operations. The downward arrows in FIG. 6 indicate the points in time at which ions are ejected from the ion trap 30. The shaded area corresponds to the time range from t=0 to t=t3 shown in FIG. 4.

In advance of an LC/MS analysis, an operator sets analysis conditions, such as the analysis termination conditions and event measurement conditions, through the operation unit 44 (Step S1). The analysis termination conditions include an analysis termination time measured from an analysis start point, a repetition count of the events to be mentioned later, and so on. The event measurement conditions define one or more events specified by a set of parameters including the ionization polarity (positive/negative ionization), measurement mass range, spectrum-averaging count and so on. A spectrum-averaging process specifically includes obtaining accumulated data by repeating the mass scan operation multiple times specified by the averaging count, and dividing the accumulated data by the averaging count. Accordingly, the spectrum-averaging count is synonymous with the number of mass scan operations. The mass range within which ions can be captured is determined by the structure, voltage-application range and other specifications of the ion trap 30. That is, the mass spectrometer has a specific measurable mass range, i.e. the maximum mass range within which the measurement can be performed. Users can specify any measurement mass range within this measurable mass range.

For example, consider the case of defining two events [1] and [2] as shown in FIG. 5: For event [1], the measurement is performed over a measurement mass range from 100 to 1000, with a positive ionization polarity and spectrum-averaging count of two. For event [2], the measurement is performed over a measurement mass range from 100 to 1000, with a negative ionization polarity and spectrum-averaging count of three.

After preparing a target sample, the operator gives a command to initiate an LC/MS analysis through the operation unit 44 (Step S2). Upon receiving this command via the central controller 43, the analysis controller 42 drives the injector 13 of the LC unit 1 to inject the target sample into the mobile phase. Simultaneously, the MS unit 2 initiates a mass analysis operation: First, the initial setting for the event to be performed is made (Step S3), and the mass analysis is carried out according to the measurement conditions for the first event (i.e. event [1] in FIG. 5).

Next, the profile data accumulation memory 403 and noise component data accumulation memory 406 in the data processor 40 are initialized (Step S4). An averaging process counter for counting the number of repetitions of the averaging process is also initialized (Step S5).

In the MS unit 2, as described previously, ions are produced from droplets sprayed from the ESI nozzle 22 to which an eluate is supplied from the column 14. These ions are temporarily stored within the ion trap 30 and then collectively ejected toward the TOF 31 at a predetermined point in time, which is t=0 in FIG. 4. The detection data reader 401 sequentially stores intensity data of the detection signals of the ion detector 33 into the detection data memory 400, associating each piece of intensity data with time t required for each ion ejected from the ion trap 30 to reach the ion detector 33. As a result of one ion-ejecting operation of the ion trap 30 followed by the collection of detection data over a predetermined period of time (from 0 to t3), a set of signal intensity data and time data is obtained (Step S6), from which a time-of-flight spectrum can be constructed as shown in FIG. 4. The voltages applied to the ion trap 30 are regulated so as to capture only the ions within the specified measurement mass range, i.e. from 100 to 1000.

The profile data reading/adding processor 402 reads out profile data from the detection data memory 400 and adds the read data to the data already present in the profile data accumulation memory 403 (Step S7), thus updating the accumulated data with new values. The profile data are the data obtained within the time range T2 corresponding to the measurement mass range specified in the event measurement conditions (i.e. 100 to 1000 in the present case). Immediately after initialization, since the data in the profile data accumulation memory 403 are all zero, the profile data that have been read out from the detection data memory 400 can be directly stored into the profile data accumulation memory 403.

The noise component data reading/adding processor 405 reads out noise component data from the detection data memory 400 and adds the read data to the data already held in the noise component data accumulation memory 406, thus updating the accumulated data with new values (Step S8). The noise component data are the data obtained within a time range where none of the signals of the ions originating from the target sample are detected (i.e. a range outside the time range T2 corresponding to the measurement mass range). Immediately after initialization, since the data in the noise component data accumulation memory 403 are all zero, the noise component data that have been read out from the detection data memory 400 can be directly stored into the noise component data accumulation memory 406.

As shown in FIG. 4, on the assumption that the ions begin their flight at t=0, there are two time ranges outside the measurement mass range: The first time range T1 is from t=0 to immediately before t=t1 at which an ion having the smallest m/z value corresponding to the lower limit of the measurement mass range arrives at the ion detector 33; the second time range T3 is from immediately after t=t2 at which an ion having the largest m/z value corresponding to the upper limit of the measurement mass range arrives at the ion detector 33, to t=t3 at which the data-collecting process is discontinued. In most cases, the latter time range T3 is longer. Therefore, the data within the time range T3 are generally suitable as the noise component data, although it depends on the measurement mass range selected. Naturally, the data within the time range T1 can also be used as the noise component data. Using the data of both time ranges T1 and T3 is also possible.

If the actual measurement mass range is close to the upper limit of the measurable mass range, a signal of an ion originating from the sample may appear within the time range T3 due to an unexpected delay of the flight of the ion or for other reasons. Mistaking such a signal for a noise component in the noise-removing process will yield incorrect information. Given this problem, the noise component data reading/adding processor 405 may preferably disregard any noise information obtained from a detection signal whose intensity equals or exceeds a specific reference value, thus excluding any signal that is too strong to be considered as a noise. The reference value may be fixed or adaptively varied.

Next, it is determined whether or not the value of the averaging process counter has reached the spectrum-averaging count that is previously specified for the current event (Step S9). If the current value is still smaller than the specified value, the value of the averaging process counter is increased by one (Step S10), and the operation returns to Step S6. As a result of the process from Steps S6 through S10, the accumulations of the profile data and noise component data are respectively performed multiple times as specified by the averaging count. In the example of FIG. 5, the specified averaging count is "2" while event [1] is being performed. Therefore, the process from Steps S6 through S10 will be repeated twice. This means that the mass scan of the ions with the "positive" polarity is performed twice, as shown in FIG. 6. After the data accumulation is repeated a predetermined number of times, the noise information calculator 407 reads out the accumulated data from the noise component data accumulation memory 406 and calculates the magnitude of noise signal (the noise level L) and its variance (or standard deviation σ) as noise information (Step S11).

The profile data averaging processor 404 reads out the accumulated data from the profile data accumulation memory 403 and divides these data by the averaging count to obtain average values. The profile data noise removing processor 408 removes the noise component from the profile spectrum obtained by the averaging process (Step S12). Specifically, it performs the following operations:

$$\text{when } i1 \geqq L+\alpha\cdot\sigma, \text{ then } i2=i1-L, \text{ and} \quad (1)$$

$$\text{when } i1 < L+\alpha\cdot\sigma, \text{ then } i2=0, \quad (2)$$

where i1 is the average profile spectrum, i2 is the profile spectrum after the noise-removing process, L is the noise level, σ is the standard deviation, and α is a predetermined coefficient whose value is normally within a range from 3 to 5. It is additionally possible to vary the coefficient α according to the measurement mode, such as the MS analysis or $MS^n$ analysis. In the present example, the value of "$L+\alpha\cdot\sigma$", which is derived from the noise level L and the standard deviation σ, corresponds to the "threshold value" used for removing the noise component in the present invention.

After the noise component has been removed from the average profile spectrum as described previously, the data processor 40 converts the time values in this profile spectrum into m/z values and performs other necessary processes, such as correcting the displacement of the m/z values, to obtain a mass spectrum (Step S13). This mass spectrum information is sent to the central controller 43, which shows the information on the screen of the display unit 45.

Subsequently, the data processor 40 determines whether or not the initially defined events have been entirely completed (Step S14). If any event is left undone, the next event is set (Step S15), and the operation returns to Step S4. In the example of FIG. 5, there are two events defined beforehand. Therefore, when the operation reaches Step S14 during the process of event [1], the determination result in this step will be "NO" since event [2] is left undone. Therefore, the measurement conditions for event [2] are set in Step S15, and the operation returns to Step S4. In this step, the profile data accumulation memory 403 and noise component data accumulation memory 406 are initialized once more, and the averaging process counter is also initialized. After that, the process from Steps S6 through S9 is repeated a specified number of times, which is now three. Subsequently, the operation proceeds to Steps S11 through S13, where a mass spectrum for event [2] is created from a profile spectrum after the noise-removing process is performed.

After the process of event [2] is completed, the operation reaches Step S14, where the determination result will be "YES" since the two initially defined events have been completed. Accordingly, the operation proceeds to Step S16, where it is determined whether or not the operation has reached the initially specified termination conditions, such as the analysis completion time. If the specified conditions have not been reached, the operation returns to Step S3 to perform the previously described process once more, starting from the first event. Thus, as shown in FIG. 6, the mass analysis operation and the corresponding data processing are repeated with the two events alternately set in order of [1], [2], [1] and so on.

That is, for event [1], the mass scan cycle is repeated twice, with each cycle including the steps of producing ions in a positive ionization mode, ejecting the ions from the ion trap 30, separating them by the TOF 31, and detecting the separated ions by the ion detector 33. Subsequently, the operational setting is switched to event [2], for which the mass scan cycle is repeated three times, with each cycle including the steps of producing ions in a negative ionization mode, ejecting the ions from the ion trap 30, separating them by the TOF 31, and detecting the separated ions by the ion detector 33. This set of two events is cyclically repeated until the analysis termination time is reached. When the analysis termination time has elapsed, the entire process is discontinued.

Thus, the LC/IT-TOFMS according to the present embodiment simultaneously yields both spectrum information within a measurement mass range and noise component information for each mass scan cycle. The time difference between the acquisition of the former information and that of the latter is negligibly small. Therefore, it is possible to correctly cancel a temporal change of the electrical noise from the ion detector 33, I/V converter 34 and amplifier 35 to obtain an accurate mass spectrum.

It is evident that the previous embodiment is a mere example and can be changed or modified within the spirit and scope of the present invention.

For example, the event measurement conditions may further include a setting required for $MS^n$ analysis in which a specified ion is dissociated one or more times within the ion trap 30 and the resultant product ions are subjected to mass analysis.

The present invention is also applicable to mass spectrometers using different types of mass separators other than the time-of-flight type. One such example is a mass spectrometer using a quadrupole mass filter, which performs the mass scan by sweeping the voltage applied to the quadrupole mass filter. In this case, the data that are usable as the noise component data can be collected when the filter is operating under a special voltage-applying condition that does not allow any ion to pass through regardless of its mass. Alternatively, for each mass scan cycle, an ion guide or other ion-transport optical systems located before the quadrupole filter may be temporarily operated under a special condition for blocking any kinds of ions. The data collected under this condition are also usable as the noise component data.

What is claimed is:

1. A method for processing data collected by a mass spectrometer including an ion source, a mass separator for performing a mass separation of ions produced by the ion source and a detector for detecting the ions resulting from the mass separation, the data being used to create a mass spectrum over a predetermined mass range, comprising:

a) a noise information acquiring step for extracting data obtained within a range where none of the ions originating from a sample arrive at the detector from among measurement data collected for each mass scan operation, and for calculating a threshold value by a statistical process based on the extracted data;

b) a profile data acquiring step for extracting a profile data, which is a data that corresponds to a measurement mass range among the measurement data;

c) a noise removing step for removing a noise component from the profile data with reference to the threshold value; and d) a spectrum creating step for creating a mass spectrum, using the profile data from which the noise component has been removed.

2. The method according to claim 1, wherein:

the mass separator is a time-of-flight the mass separator; and the noise information acquiring step is a step of extracting data from either a first time range from a point in time when ions are introduced into the time-of-flight mass separator to a point in time when an ion having a smallest mass within a measurable mass range reaches the detector, or a second time range from a point in time when an ion having a largest mass within the measurable mass range reaches the detector to a point in time when collection of data for one cycle of mass scan operation is completed.

3. The method according to claim 2, wherein the data extracted from the second time range are used as a basis for calculating the threshold value.

4. The method according to claim 3, wherein data obtained from a signal detected within the second time range is disregarded from the calculation of the threshold value if an intensity of the signal equals or exceeds a predetermined reference value.

5. A mass spectrometer including an ion source, a mass separator for performing a mass separation of ions produced by the ion source, a detector for detecting the ions resulting from the mass separation, and a data processor for processing measurement data obtained by the detector, the measurement data being used to create a mass spectrum over a predetermined mass range, comprising:

a) a noise information acquiring means for extracting data obtained within a range where none of the ions originating from a sample arrive at the detector from among the measurement data collected for each mass scan operation, and for calculating a threshold value by a statistical process based on the extracted data;

b) a profile data acquiring means for extracting a profile data, which is a data that corresponds to a measurement mass range among the measurement data;

c) a noise removing means for removing a noise component from the profile data with reference to the threshold value; and d) a spectrum creating means for creating a mass spectrum, using the profile data from which the noise component has been removed.

6. The mass spectrometer according to claim 5, wherein:

the mass separator is a time-of-flight the mass separator; and the noise information acquiring means extracts data from either a first time range from a point in time when ions are introduced into the time-of-flight mass separator to a point in time when an ion having a smallest mass within a measurable mass range reaches the detector, or a second time range from a point in time when an ion having a largest mass within the measurable mass range reaches the detector to a point in time when collection of data for one cycle of mass scan operation is completed.

7. The mass spectrometer according to claim 6, wherein the data extracted from the second time range are used as a basis for calculating the threshold value.

8. The mass spectrometer according to claim 7, wherein data obtained from a signal detected within the second time range is disregarded from the calculation of the threshold value if an intensity of the signal equals or exceeds a predetermined reference value.

9. The mass spectrometer according to claim 5, which is capable of repeatedly performing the mass scan operation under different sets of analysis conditions, wherein:

the mass spectrometer further includes a condition setting means for specifying the analysis conditions for the mass scan operation and an analysis controlling section for collecting data for each mass scan operation while cyclically repeating a series of mass scan operations performed under different sets of analysis conditions specified through the condition setting section; and the noise information acquiring means extracts data corresponding to the noise from the measurement data obtained for each of the mass scan operations performed under the different sets of analysis conditions.

10. The mass spectrometer according to claim 6, which is capable of repeatedly performing the mass scan operation under different sets of analysis conditions, wherein:

the mass spectrometer further includes a condition setting means for specifying the analysis conditions for the mass scan operation and an analysis controlling section for collecting data for each mass scan operation while cyclically repeating a series of mass scan operations performed under different sets of analysis conditions specified through the condition setting section; and the noise information acquiring means extracts data corresponding to the noise from the measurement data obtained for each of the mass scan operations performed under the different sets of analysis conditions.

11. The mass spectrometer according to claim 9, wherein the analysis conditions includes a polarity of the ions produced by the ion source.

12. The mass spectrometer according to claim 10, wherein the analysis conditions includes a polarity of the ions produced by the ion source.

* * * * *